United States Patent [19]

Marty

[11] 4,403,487

[45] Sep. 13, 1983

[54] ONE PIECE KEY IDENTIFICATION COVER

[76] Inventor: Frederic C. Marty, 2919 N. Vincent Ave., Minneapolis, Minn. 55411

[21] Appl. No.: 308,063

[22] Filed: Oct. 2, 1981

[51] Int. Cl.[3] ..... E05B 19/04; A47G 29/10

[52] U.S. Cl. ..... 70/408; 70/457; 70/458

[58] Field of Search ..... 70/457, 456 R, 458, 70/408, 395; 150/40

[56] References Cited

U.S. PATENT DOCUMENTS

| | | | |
|---|---|---|---|
| 1,494,498 | 3/1931 | Ridgway . | |
| 1,837,114 | 12/1931 | Cicourel . | |
| 1,966,550 | 7/1934 | Handy . | |
| 2,138,309 | 11/1938 | Stevenson . | |
| 2,982,041 | 5/1961 | Kent . | |
| 3,225,478 | 12/1965 | Rohmer . | |
| 4,305,227 | 12/1981 | Nish | 70/408 |

FOREIGN PATENT DOCUMENTS

| | | | |
|---|---|---|---|
| 1151449 | 9/1959 | Fed. Rep. of Germany | 70/408 |

*Primary Examiner*—Robert L. Wolfe
*Attorney, Agent, or Firm*—Wicks & Nemer

[57] ABSTRACT

A one piece key identification cover including a hollow body of resilient deformable material and having a flat top portion connected to a flat bottom portion by opposed sidewalls. The end portion of the body is restricted with an opening communicating with the interior of the hollow body and through which a portion of a key is extended outwardly of the body. The flat top portion has a slit formed therethrough and through which a key is forced into the body member with the narrow portion of a key extended outwardly through the restricted opening portion and the remaining head portion of the key within the body against displacement.

10 Claims, 8 Drawing Figures

ONE PIECE KEY IDENTIFICATION COVER

SUMMARY

The invention relates to key identification covers and more particularly to a one piece cover in which the enlarged head portion of a key is encapsulated with securement therin and leaving the remaining narrow portion of the key for use with a lock. The holder includes a relatively flat but hollow body, one flat wall thereof having a slit and one end of the body having an opening. The body is made of a resilient conventional deformable plastic, and a key is mounted in the cover holder by forcing it into the body through the slit with the narrow operative end of the key extending from the body of the cover holder. As a result of the above, the key is held in the cover against displacement. The body has ad space externally thereof on the substantially flat sides. Additionally, a flat side of the cover body may have thereon the printed or written identification of the key. An identification disc may be easily inserted through the slit and into the body and under the head of the key whereby it is substantially protected and not subject to displacement.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
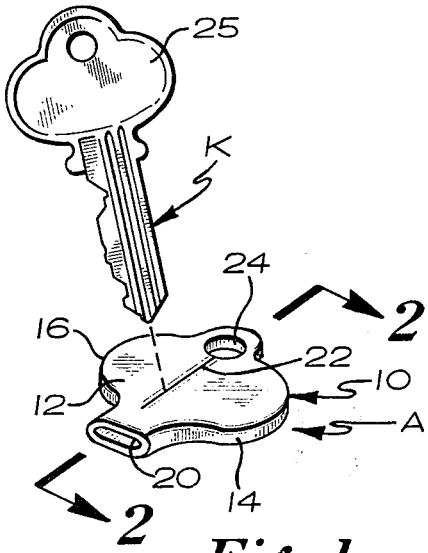
FIG. 1 is a perspective view of a one-piece key identification cover embodying the invention and shown with a key in position for insertion into the cover.

Referring to the drawings in detail, the key identification cover A includes the envelope body 10 of resilient deformable plastic material or the like. The hollow body 10 includes the substantially flat top portion 12 which terminates on one side in the outwardly curving first sidewall 14 with the other side terminating in the outwardly curving second sidewall 16. The sidewalls terminate in the flat uninterrupted bottom portion 18 which is coextensive with the flat top portion 12. The flat bottom provides desirable key identification and/or ad space.

The top, bottom and sidewalls terminate at one end in reduced portions to form a restricted opening 20 through which a portion of a key extends as set forth hereinafter. The flat top portion 12 has extending therethrough the slit 22 toward each end of the top portion. The slit is deformable due to the deformable nature of the material of which the cover A is formed. At the other end of the body opposite to the opening 20 is the hole 24 formed in the top 12 and the hole 26 formed in the bottom 18 which is in alignment with the hole 24. The holes 24 and 26 are adapted to align with a hole in the head portion 25 of a conventional key K when a key is inserted in the holder A as will be described hereinafter. The conventional key K also includes the conventional lock-operating end portion 27.

Further provided is the relatively thin flat identification disc 28 member of a size to fit and be held within the holder underneath the key K where it is protected from wear and further deterioration.

Figure 2:
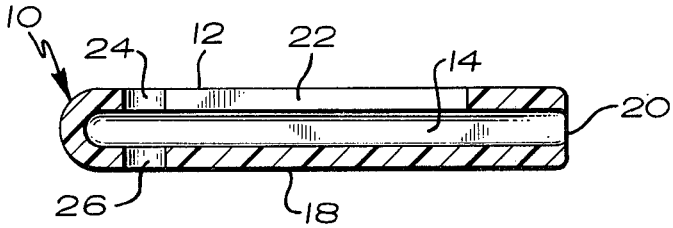
FIG. 2 is a sectional view on the line 2—2 of FIG. 1.
Figure 8:
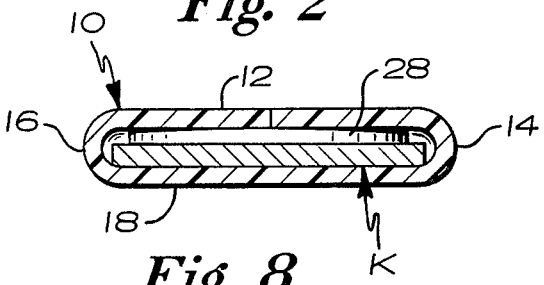
FIG. 8 is a sectional view on the line 8—8 of FIG. 6.
Figure 3:
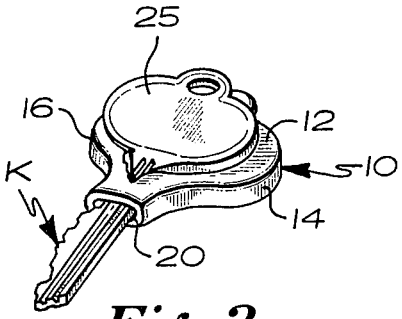
FIG. 3 is a view similar to FIG. 1 with the key partially inserted into the cover.
Figure 4:
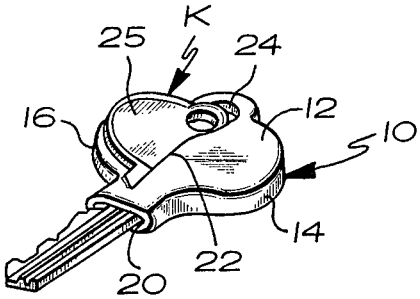
FIG. 4 shows the key further inserted into the cover.
Figure 5:
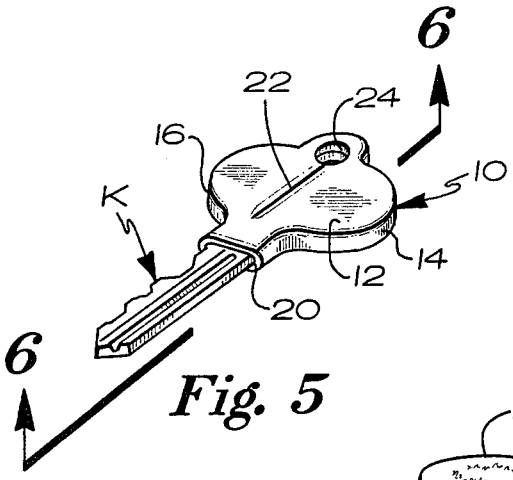
FIG. 5 shows the key fully inserted into the cover.
Figure 7:
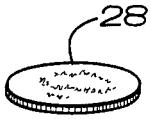
FIG. 7 is a perspective view of an identification disc.
Figure 6:
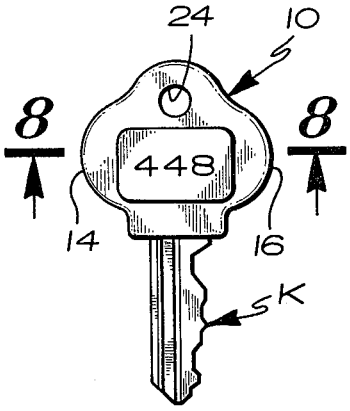
FIG. 6 is a top plan view of the cover.

The cover A is manipulated and used in the following manner and referring to FIGS. 1–4, the small operative end of a key K is extended into the slit 22 and the entire key including the head portion completely forced through the slit with the small lock-operating end of the key 27 extended out the restricted opening 20 with the head 25 of the key K encapsulated in the cover, the end 27 of the key being useable with a lock. It will be seen that with the key K partially within the cover as in FIG. 4, the cover A is securely mounted against displacement from the key. Additionally, the identification disc is contained in the holder against separation therefrom. The key is removed from the holder A by deforming the slot whereby the head of the key may be first forced out the hole followed by the operative end of the key.

With the holes 24 and 26 in alignment with the hole in the head portion of a key, a chain, ring or holder may be inserted and secured through the cover and the key.

The cover A may have a coloring matter including irridescent incorporated therewith, whereby the key may be identified simply by sight. The cover A may be constructed if a size is excess of the size of the head of the key whereby identification of the key may be made by sight or feel particularly valueable for sightless persons.

Having thus described the invention, what is claimed as new and desired to be secured by Letters Patent is:

1. A key identification cover including (a) a hollow body of deformable material having an enlarged portion terminating in (b) a restricted portion at one end thereof with an opening therein communicating with the interior of the hollow body portion and through which a portion of a key is extendable, said hollow body including (1) a substantially closed, flat top portion connected to (2) a substantially closed, flat bottom portion by (3) opposed spaced sidewalls, (c) said substantially closed, flat top portion of said hollow body having a slit opening formed therein through which a key is inserted into the hollow body with a portion of a key extending partially out of said restricted opening portion and the head portion of the key within the hollow body, (d) the other end of said body portion having means for connecting a holder to the body.

2. The device of claim 1, in which the body is irredescent for identification.

3. The device of claim 1, in which said body is colored for identification.

4. The device of claim 1 further including a relatively thin flat identification disc for insertion within said hollow body portion and for holding between the key and the hollow body portion.

5. A key identification cover including (a) a hollow body of deformable material having an enlarged portion terminating in (b) a restricted portion at one end thereof with an opening therein communicating with the interior of the hollow body portion and through which a portion of a key is extendable, (c) said hollow body having an opening formed therein through which a key is inserted into the hollow body with a portion of a key extending partially out of said restricted opening portion and the head portion of the key within the hollow body, with said hollow body opening being in the form of a slit having a length about one-half of the length of said body, (d) the other end of said body portion having means for connecting a holder to the body.

6. The device of claim 5 in which said hollow body includes (a) a substantially flat top portion connected to (b) a substantially flat bottom portion by (c) opposed spaced sidewalls.

7. The device of claim 6 in which said hollow body opening is in the form of a slit having a length about one-half of the length of said body.

8. The device of claim 7 in which said means for connecting a holder to said body includes a hole extending through the body through which a holder member may be extended.

9. The device of claim 5 further including a relatively thin flat identification disc for insertion within said hollow body portion and for holding between the key and the hollow body portion.

10. The device of claim 5 in which said means for connecting a holder to said body includes a hole extending through the body through which a holder member may be extended.

* * * * *